US006659561B1

(12) United States Patent
Lee

(10) Patent No.: US 6,659,561 B1
(45) Date of Patent: Dec. 9, 2003

(54) ARM REST ADJUSTABLE FORWARDLY AND REARWARDLY

(76) Inventor: Hwang Pao Lee, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/425,062

(22) Filed: Apr. 26, 2003

(51) Int. Cl.[7] ..... A47C 7/54
(52) U.S. Cl. ..... 297/411.35; 297/411.36
(58) Field of Search ..... 297/353, 411.35, 297/411.36, 411.37

(56) References Cited

U.S. PATENT DOCUMENTS 4,934,750 A * 6/1990 Eichler et al. ..... 297/411.35
5,927,811 A * 7/1999 Tseng ..... 297/353
6,053,578 A * 4/2000 van Hekken et al. ... 297/411.35
6,059,366 A * 5/2000 Hu ..... 297/411.35
6,074,012 A * 6/2000 Wu ..... 297/411.26
6,502,904 B1 * 1/2003 Hansen ..... 297/411.35

* cited by examiner

*Primary Examiner*—Peter R. Brown

(57) ABSTRACT

An adjustable arm rest includes a plate secured on top of a housing with one or more fasteners and having one or more catches, and a casing slidably engage with the fasteners to guide the casing to slide relative to the housing and the plate. A board is slidably disposed above the plate and includes a number of recesses to selectively receive the catches of the plate, and to adjustably position the board and the casing to the plate and the housing. A follower may force the board away from the plate, to selectively disengage the catches of the plate from the board, and to allow the casing to be adjusted forwardly and rearwardly relative to the casing.

12 Claims, 8 Drawing Sheets

ARM REST ADJUSTABLE FORWARDLY AND REARWARDLY

BACKGROUND OF THE INVENTION

1. Field of the Invention

The present invention relates to an armrest, and more particularly to an adjustable armrest adjustable up and down and adjustable forwardly and rearwardly relative to chairs or objects.

2. Description of the Prior Art

Various kinds of typical armrests have been developed and provided to solidly attach to the chairs or the like for supporting the arms of the users. The arm rests may be moved up and down together with the chairs when the chairs are moved or adjusted up and down relative to a supporting base, but may not be adjusted up and down relative to the chairs.

The other typical arm rests comprise an adjustable structure for moving or adjusting up and down relative to the chairs, in order to support the arms of the users at different heights or elevations. However, the typical arm rests may only be adjusted up and down relative to the chairs, but may not be adjusted forwardly or rearwardly relative to the chairs to different forward or rearward positions.

The present invention has arisen to mitigate and/or obviate the afore-described disadvantages of the conventional adjustable armrests.

SUMMARY OF THE INVENTION

The primary objective of the present invention is to provide an adjustable armrest, which is adjustable up and down and adjustable forwardly and rearwardly relative to the chairs or objects.

In accordance with one aspect of the invention, there is provided an adjustable arm rest comprising a housing including an upper portion, a plate secured to the upper portion of the housing with at least one fastener, and including at least one catch extended therefrom, a casing slidably disposed on the upper portion of the housing, and including at least one channels formed therein, to slidably receive the fastener, and to guide the casing to slide relative to the housing and the plate, a board slidably disposed in the casing, and disposed above the plate, and including a bottom portion having a plurality of recesses formed therein, to selectively receive the catch of the plate, and to selectively or adjustably position the board and the casing to the plate and the housing, and means for forcing the board away from the plate, to selectively disengage the catch of the plate from the recesses of the board, and to allow the board and the casing to move and adjust forwardly and rearwardly relative to the plate and the casing when the catch of the plate is disengaged from the recesses of the board.

The casing includes at least one pin extended therefrom, the board includes at least one hole formed therein to slidably receive the pin of the casing, and to guide the board to move up and down and toward and away from the plate and the casing.

One or more springs may further be provided and engaged with the board, to bias the board toward the plate, and to force and engage the catch of the plate into either of the recesses of the board.

The forcing means includes at least one bulge extended from the board, and a follower slidably received between the board and the plate, the follower includes at least one swelling extended therefrom, for engaging with the bulge of the board, to force the board away from the plate when the follower is forced to move relative to the board.

The board includes a groove formed therein to slidably receive the follower. One or more springs may further be provided and coupled between the follower and the casing, to bias and disengage the swelling of the follower away from the bulge of the board.

The forcing means includes a lever having a middle portion pivotally secured to the casing, and having a first end engageable with the follower to move the follower relative to the board and the plate and the casing, and having a second end to be actuated to rotate the lever and to force the first end of the lever to engage with the follower. The casing includes an opening formed therein to receive the second end of the lever.

A post may further be provided for attaching to an object, the housing includes a chamber formed therein to slidably receive the post, to allow the housing to be moved up and down relative to the post to different elevations.

A latch may further be provided and attached to the housing, to selectively engage with the post, and to position the housing to the post at selected positions. The post includes a plurality of notches formed therein, the latch includes a bar extended therefrom and engageable with either of the notches of the post, to position the housing to the post at the selected positions.

The housing includes a plurality of orifices to selectively and slidably receive the latch, the bar of the latch includes a passage formed therein to slidably receive the post, and to allow the bar and the housing to be moved up and down relative to the post.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
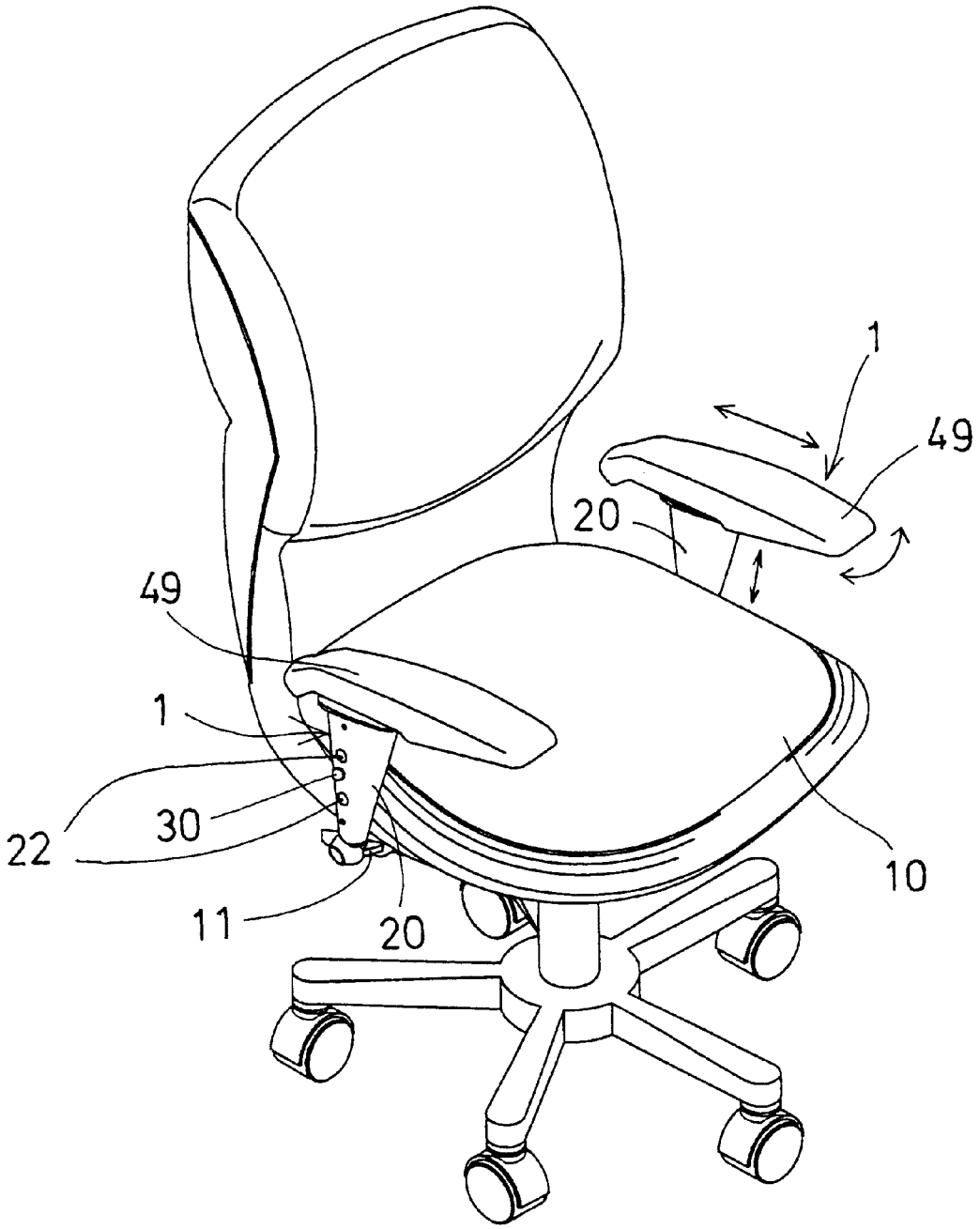
FIG. 1 is a perspective view of a chair having an adjustable armrest in accordance with the present invention.
Figure 2:
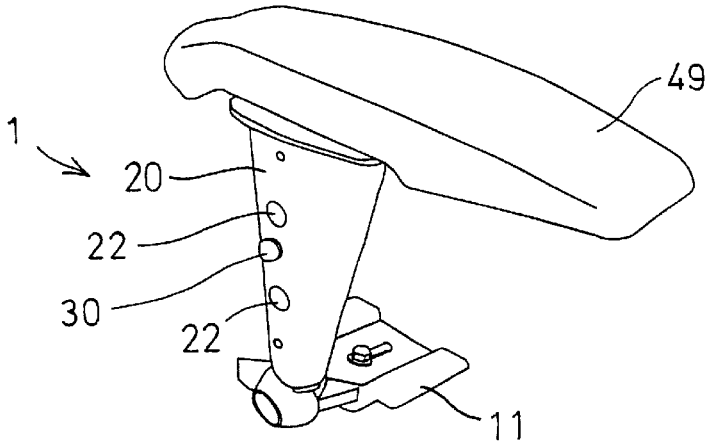
FIG. 2 is a perspective view of the adjustable armrest.
Figure 10:
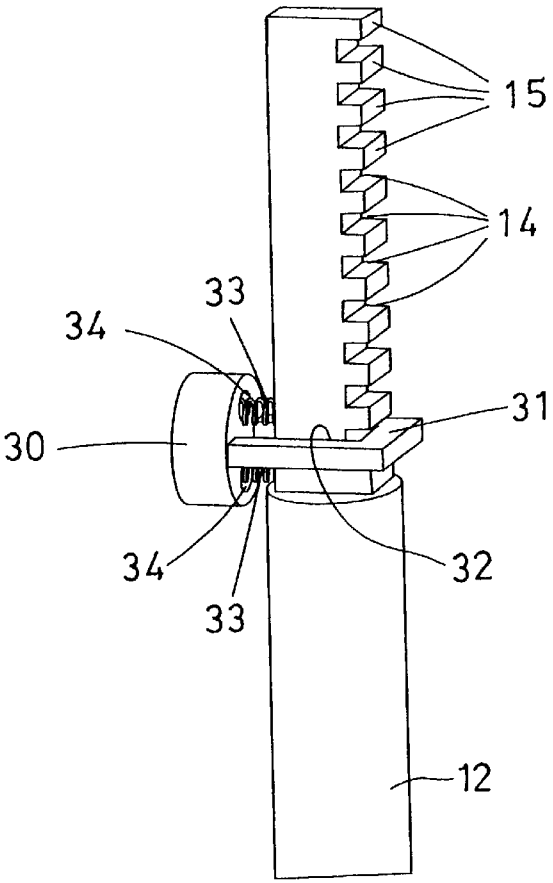
FIG. 10 is a partial perspective view showing a post extended from the chair to support the adjustable arm rest.

Referring to the drawings, and initially to FIGS. 1 and 2, an adjustable arm rest 1 in accordance with the present invention is provided for attaching to either side of an object 10, such as a chair 10 or the like, and comprises a bracket 11 secured to the object 10, and a post 12 secured to or extended up from the bracket 11. The post 12 includes a number of notches 14 formed therein and defined by or between projections 15 (FIG. 10).

Figure 3:
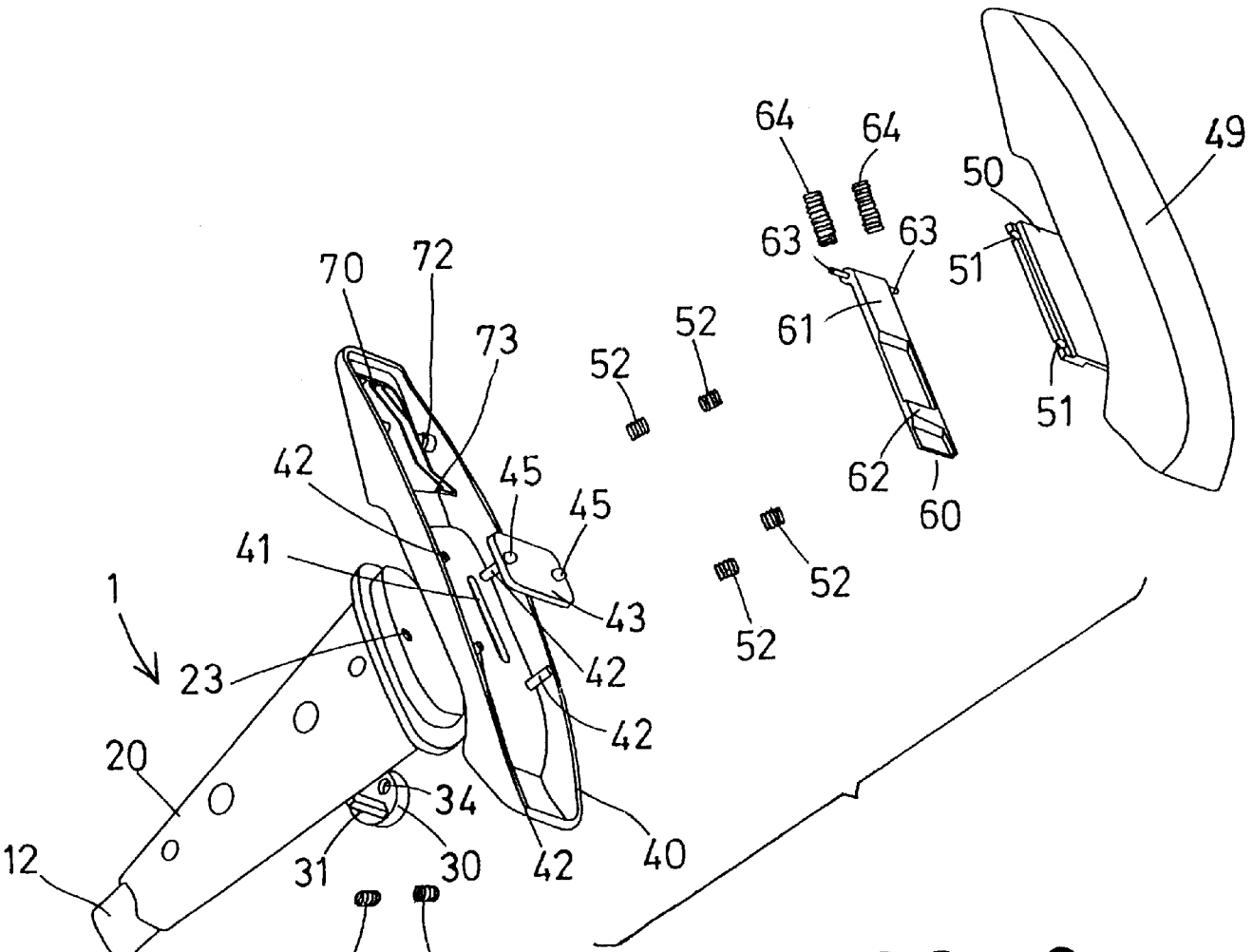
FIG. 3 is an exploded view of the adjustable armrest as seen from the left side of the upper and rear portion thereof.
Figure 9:
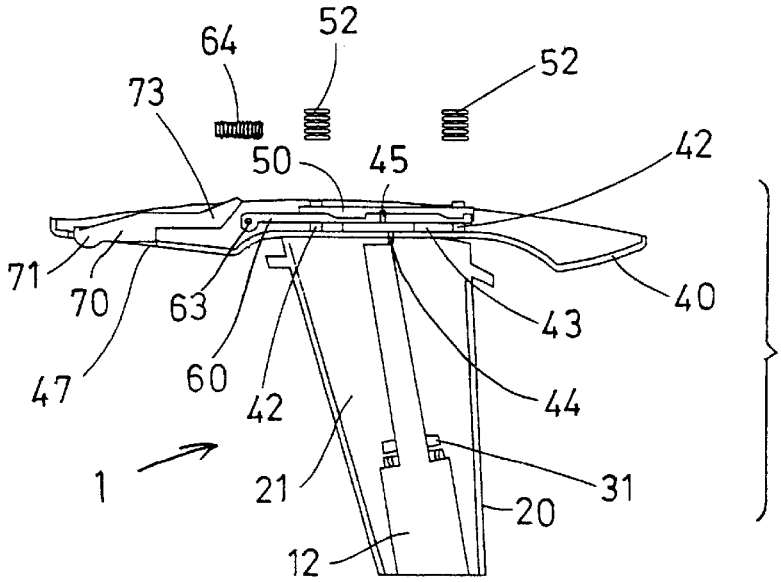
FIG. 9 is a partial cross sectional view taken along lines 9—9 of FIG. 8.
Figure 11:
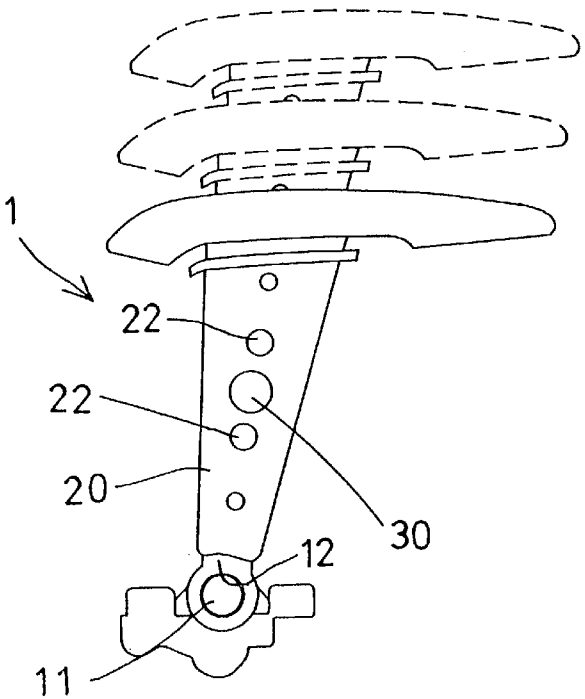
FIG. 11 is a plan schematic view illustrating the operation of the adjustable armrest.

The arm rest 1 includes a housing 20 having a chamber 21 formed therein (FIG. 9) to slidably receive the post 12, for allowing the housing 20 to be moved or adjusted up and down relative to the post 12 and the bracket 11 and thus the chair 10 to different heights or elevations, best shown in FIG. 11. The housing 20 includes a number of orifices 22 formed in one of the side portions thereof, and includes one or more, such as two apertures 23 formed in the upper portion thereof (FIGS. 3, 4).

As shown in FIGS. 3, 4, 6, 10, a latch 30 includes a bar 31 extended therefrom and slidably engaged into the chamber 21 of the housing 20 via either of the orifices 22 of the housing 20. The bar 31 of the latch 30 includes a passage 32 formed therein to slidably receive the post 12 (FIGS. 9, 10), and is engageable with either of the notches 14 and/or the projections 15 of the post 12 (FIG. 10), in order to secure and position the latch 30 to the post 12.

Figure 7:
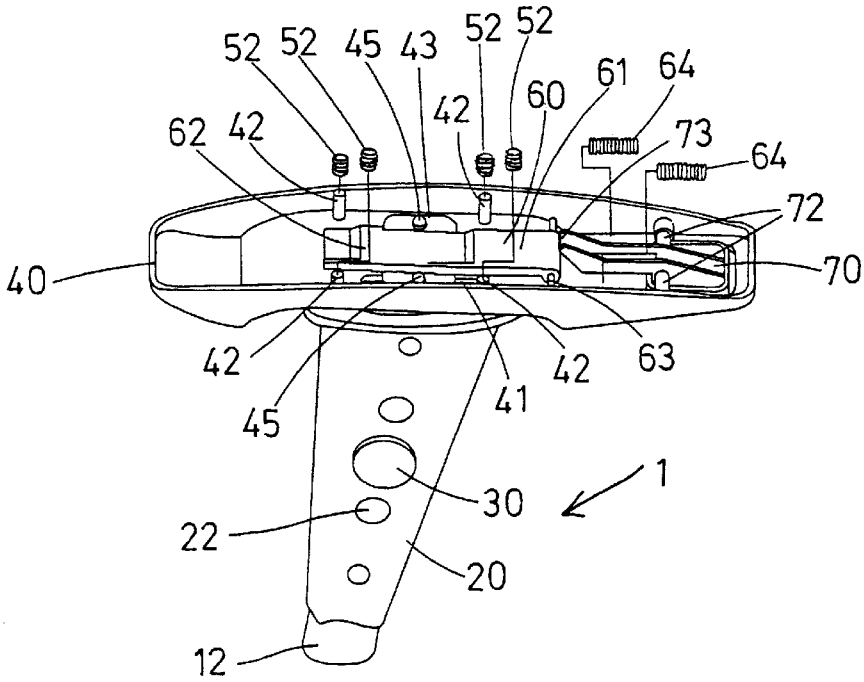
FIG. 7 is a partial perspective view of the adjustable arm rest as seen from the right side of the upper portion thereof, in which some upper parts or elements of the arm rest have been removed.
Figure 4:
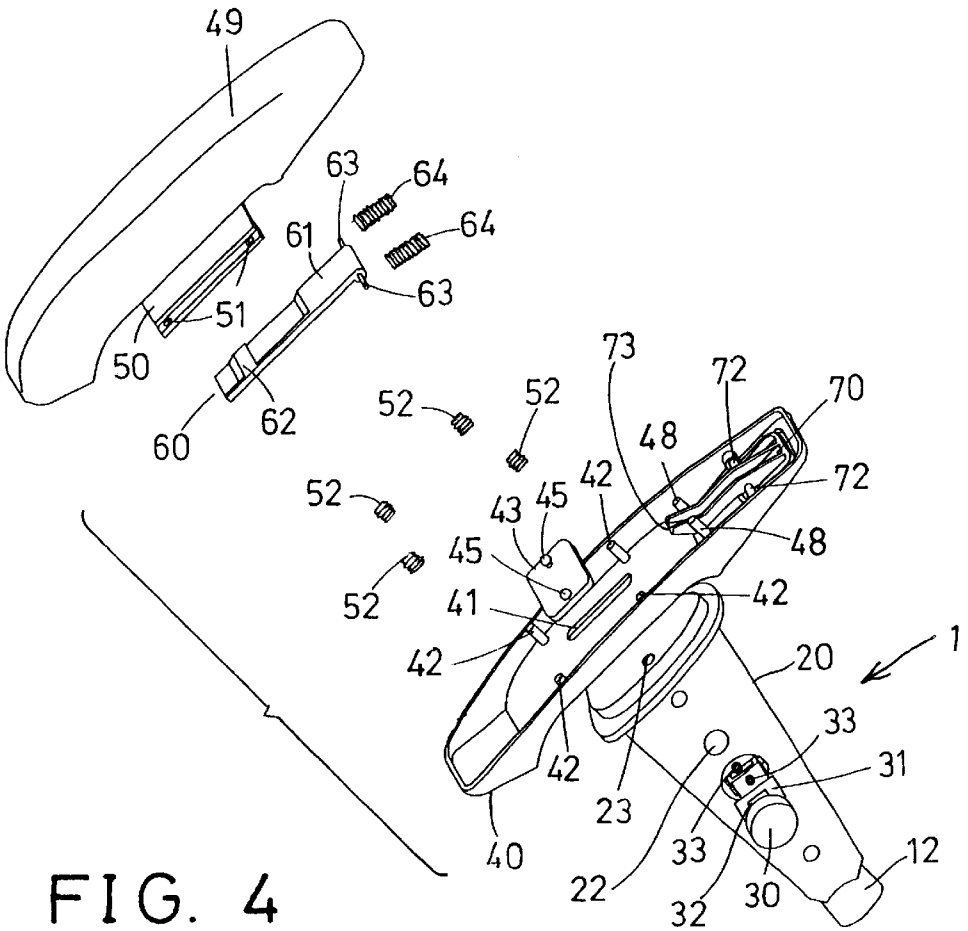
FIG. 4 is an exploded view of the adjustable armrest as seen from the right side of the upper and rear portion thereof.
Figure 6:
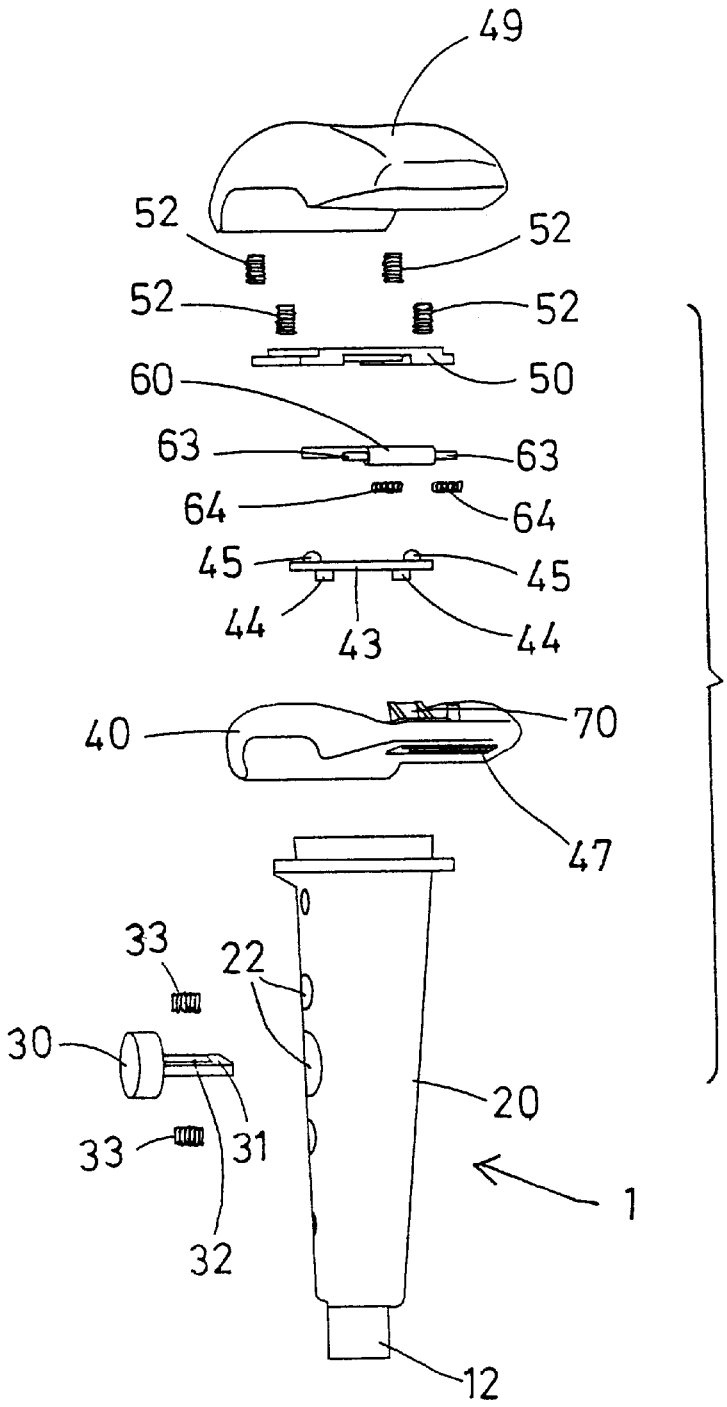
FIG. 6 is an exploded view of the adjustable armrest as seen from the front and side portion thereof.

As shown in FIGS. 4, 6, 7, the latch 30 is slidably received in either of the orifices 22 of the housing 20, and slightly extendible out of the housing 20, so as to be depressed toward or into the housing 20 by users. One or more, such as two springs 33 are disposed between the latch 30 and the post 12 and/or partially received in the depressions 34 of the latch 30 (FIG. 10), to bias the latch 30 to partially or slightly extend out of the housing 20, and to force the bar 31 of the latch 30 to engage with the post 12.

In operation, the bar 31 of the latch 30 may be biased or forced to engage with either of the notches 14 and/or the projections 15 of the post 12 (FIG. 10), by the springs 33, in order to secure and position the latch 30 and thus the housing 20 to the post 12 at the selected or required position. At this moment, the latch 30 is also biased or forced to partially or slightly extend out of the housing 20 by the springs 33.

When the latch 30 is depressed toward or into the housing 20 against the springs 33 by the users, the bar 31 of the latch 30 may be moved or forced to be disengaged from the notches 14 and/or the projections 15 of the post 12 (FIG. 10), against the springs 33. At this moment, the latch 30 and thus the housing 20 may be moved or adjusted up and down relative to the post 12 to any selected or required position, until the bar 31 of the latch 30 is biased or forced to engage with either of the notches 14 and/or the projections 15 of the post 12 again by the springs 33, when the latch 30 is released by the users.

The arm rest 1 includes a casing 40 slidably disposed above the housing 20, and having one or more, such as two oblong holes or channels 41 formed therein and aligned with the apertures 23 of the housing 20 respectively, and having one or more, such as four pins 42 extended therefrom. The casing 40 includes an opening 47 formed therein (FIGS. 5, 6, 9), such as formed in the front and bottom portion thereof.

A plate 43 includes one or more, such as two fasteners 44 extended downwardly therefrom and slidably extended through the channels 41 of the casing 40, and engaged into the apertures 23 of the housing 20, and secured to the housing 20. As shown in FIGS. 3–6, the fasteners 44 of the plate 43 may be slidably received in the channels 41 of the casing 40, such that the casing 40 may be slidably secured to the housing 20 with the plate 43.

The sliding engagement of the fasteners 44 of the plate 43 in the channels 41 of the casing 40 may thus be used to limit the relative sliding movement between the casing 40 and the housing 20. The plate 43 includes one or more catches 45 extended upwardly therefrom. A cover 49 may be secured onto the casing 40 with such as fasteners (not shown), latches (not shown), adhesive materials, or by welding processes, in order to cover and shield the plate 43 or the other parts or elements received in the casing 40.

A board 50 is slidably disposed above the plate 43, and includes one or more, such as four holes 51 formed therein to slidably receive the pins 42 of the casing 40, and to guide the board 50 to move up and down or toward or away from the plate 43 and the casing 40. One or more, such as four springs 52 are engaged onto the pins 42 and/or engaged between the board 50 and the cover 49 for biasing the board 50 to slidably engage with the pins 42 of the casing 40.

The board 50 includes two rows of recesses 53, 54 formed therein (FIG. 5), such as formed in the bottom portion thereof, to. receive the catches 45 of the plate 43. For example, the catches 45 of the plate 43 may be forced to engage into the recesses 53, 54 of the board 50, in order to position the board 50 and the casing 40 to the plate 43 and the housing 20, and so as to prevent the casing 40 from being moved forwardly and rearwardly relative to the housing 20.

It is to be noted that the recesses 53 of the board 50 include a width or length smaller than that of the other recesses 54 of the board 50. When a first catch 45 of the catches 45 of the plate 43 is engaged into either of the smaller recesses 53 of the board 50, the first catch 45 may not be moved relative to the board. The other or the second catch 45 will thus be loosely engaged into either of the greater recesses 54 of the board 50, and may thus be slightly moved relative to the board, such that the board 50 and thus the casing 40 may be slightly rotated relative to the plate 43 and the housing 20.

Figure 5:
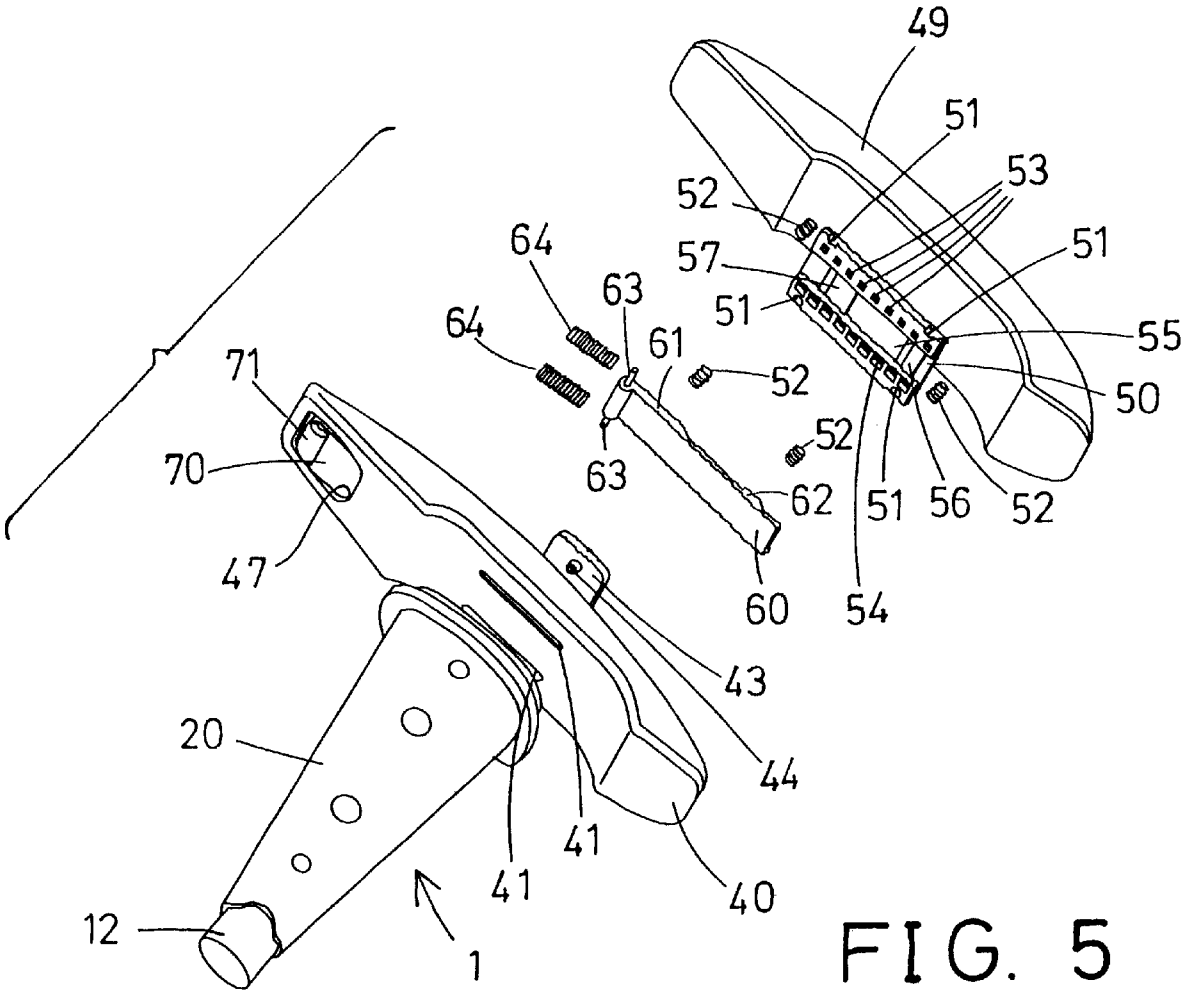
FIG. 5 is an exploded view of the adjustable armrest as seen from the lower and rear portion thereof.

As also shown in FIG. 5, the board 50 further includes a groove 55 formed therein, and includes one or more, such as two bulges 56, 57 extended therefrom, such as extended into the groove 55 thereof.

A follower 60 is slidably received in the groove 55 of the board 50, and includes one or more, such as two swellings 61, 62 extended therefrom, for engaging with the bulges 56, 57 of the board 50, in order to move or to force the board 50 upwardly away from the plate 43 against the springs 52, when the follower 60 is forced to move along the groove 55 of the board 50.

Figure 8:
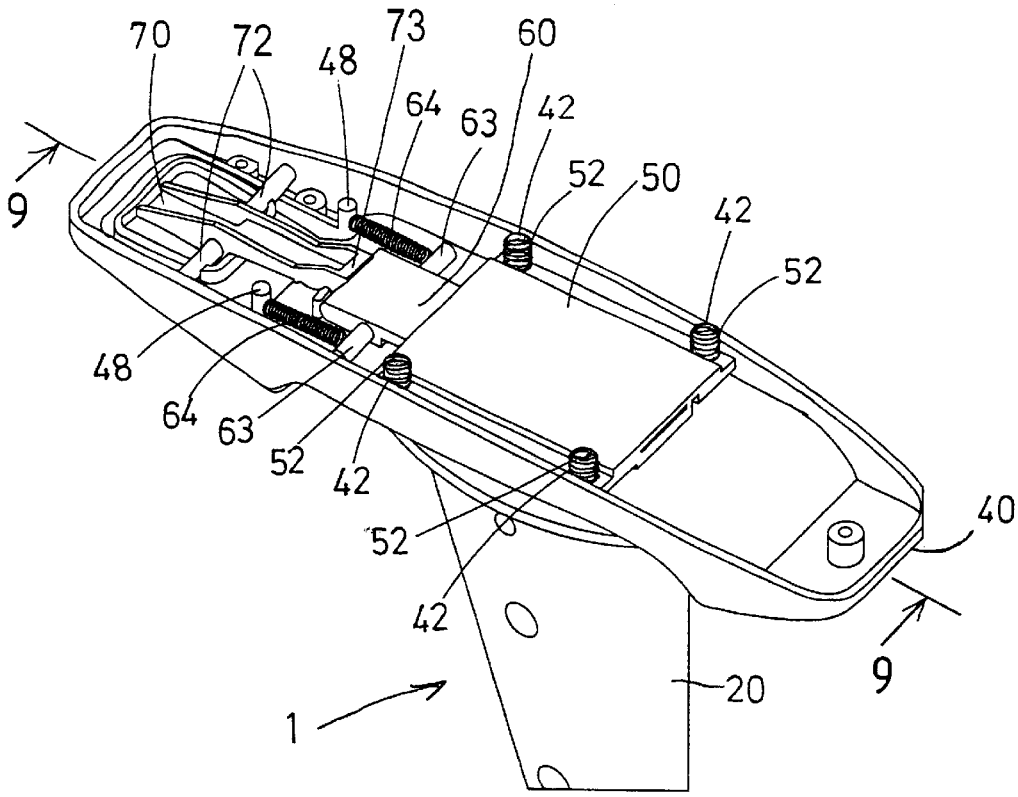
FIG. 8 is a partial perspective view of the adjustable arm rest as seen from the left side of the upper and rear portion thereof, in which some upper parts or elements of the arm rest have been removed.

The follower 60 and includes one or more, such as two rods 63 extended therefrom, and each coupled to one or more springs 64 respectively. The springs 64 are coupled to one or more pegs 48 (FIG. 8) that are extended from the casing 40, in order to bias and to move the swellings 61, 62 of the follower 60 away from the bulges 56, 57 of the board 50, and thus for allowing the catches 45 of the plate 43 to be forced to engage into the recesses 53, 54 of the board 50 and to position the board 50 and the casing 40 to the plate 43 and the housing 20.

A lever 70 includes a middle portion rotatably or pivotally secured to the casing 40 with a pivot axle 72, and includes one end 71 slightly extended out through the opening 47 of the casing 40, and the other actuating end 73 engageable with the follower 60 (FIGS. 7–9), in order to move the follower 60 relative to the board 50 and the plate 43 and the casing 40 and against the springs 64, when the actuating end 73 is forced toward and to engage with the follower 60 by actuating or depressing the end 71 of the lever 70 into the opening 47 of the casing 40.

In operation, when the end 71 of the lever 70 is actuated or depressed into the opening 47 of the casing 40 by the users, the actuating end 73 may be forced toward and to engage with the follower 60, in order to move the follower 60 relative to the board 50 and the plate 43 and the casing 40 and against the springs 64, and so as to move the swellings 61, 62 of the follower 60 to engage with the bulges 56, 57 of the board 50, and thus to move or to force the board 50 upwardly away from the plate 43 against the springs 52.

At this moment, the catches 45 of the plate 43 may be disengaged from the recesses 53, 54 of the board 50, and the board 50 and the casing 40 may thus be moved or adjusted relative to the plate 43 and the housing 20, thus for allowing the casing 40 to be moved or adjusted forwardly and rearwardly relative to the housing 20.

Accordingly, the adjustable armrest in accordance with the present invention may be adjusted up and down and may be adjusted forwardly and rearwardly relative to the chairs or objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable armrest comprising:

a housing including an upper portion, a plate secured to said upper portion of said housing with at least one fastener, and including at least one catch extended therefrom, a casing slidably disposed on said upper portion of said housing, and including at least one channel formed therein, to slidably receive said at least one fastener, and to guide said casing to slide relative to said housing and said plate, a board slidably disposed in said casing, and disposed above said plate, and including a bottom portion having a plurality of recesses formed therein, to selectively receive said at least one catch of said plate, and to selectively or adjustably position said board and said casing to said plate and said housing, and means for forcing said board away from said plate, to selectively disengage said at least one catch of said plate from said recesses of said board, and to allow said board and said casing to move and adjust relative to said plate and said casing when said at least one catch of said plate is disengaged from said recesses of said board.

2. The adjustable arm rest as claimed in claim 1, wherein said casing includes at least one pin extended therefrom, said board includes at least one hole formed therein to slidably receive said at least one pin of said casing, and to guide said board to move up and down and toward and away from said plate and said casing.

3. The adjustable arm rest as claimed in claim 1 further comprising at least one spring engaged with said board, to bias said board toward said plate, and to force and engage said at least one catch of said plate into either of said recesses of said board.

4. The adjustable arm rest as claimed in claim 1, wherein said forcing means includes at least one bulge extended from said board, and a follower slidably received between said board and said plate, said follower includes at least one swelling extended therefrom, for engaging with said at least one bulge of said board, to force said board away from said plate when said follower is forced to move relative to said board.

5. The adjustable armrest as claimed in claim 4, wherein said board includes a groove formed therein to slidably receive said follower.

6. The adjustable arm rest as claimed in claim 4 further comprising at least one spring coupled between said follower and said casing, to bias and disengage said at least one swelling of said follower away from said at least one bulge of said board.

7. The adjustable arm rest as claimed in claim 4, wherein said forcing means includes a lever having a middle portion pivotally secured to said casing, and having a first end engageable with said follower to move said follower relative to said board and said plate and said casing, and having a second end to be actuated to rotate said lever and to force said first end of said lever to engage with said follower.

8. The adjustable arm rest as claimed in claim 7, wherein said casing includes an opening formed therein to receive said second end of said lever.

9. The adjustable arm rest as claimed in claim 1 further comprising a post for attaching to an object, said housing including a chamber formed therein to slidably receive said post, to allow said housing to be moved up and down relative to said post to different elevations.

10. The adjustable arm rest as claimed in claim 9 further comprising a latch attached to said housing, to selectively engage with said post, and to position said housing to said post at selected positions.

11. The adjustable arm rest as claimed in claim 10, wherein said post includes a plurality of notches formed therein, said latch includes a bar extended therefrom and engageable with either of said notches of said post, to position said housing to said post at the selected positions.

12. The adjustable arm rest as claimed in claim 10, wherein said housing includes a plurality of orifices to selectively and slidably receive said latch, said bar of said latch includes a passage formed therein to slidably receive said post, and to allow said bar and said housing to be moved up and down relative to said post.

* * * * *